US005499015A

United States Patent [19]

Winkler et al.

[11] Patent Number: 5,499,015

[45] Date of Patent: Mar. 12, 1996

[54] MAGNETOMECHANICAL EAS COMPONENTS INTEGRATED WITH A RETAIL PRODUCT OR PRODUCT PACKAGING

[75] Inventors: Stephen Winkler, Boca Raton; Hans Witzky, Pompano Beach; Alan Willard, Wellington, all of Fla.

[73] Assignee: Sensormatic Electronics Corp., Deerfield Beach, Fla.

[21] Appl. No.: 314,087

[22] Filed: Sep. 28, 1994

[51] Int. Cl.[6] ..... G08B 13/187

[52] U.S. Cl. ..... 340/551; 340/572

[58] Field of Search ..... 340/551, 572

[56] References Cited

U.S. PATENT DOCUMENTS

| | | | |
|---|---|---|---|
| 3,665,449 | 5/1972 | Elder et al. | 340/551 |
| 4,063,229 | 12/1977 | Welsh et al. | 340/572 |
| 4,151,405 | 4/1979 | Peterson | 235/382 |
| 4,342,904 | 8/1982 | Onsager | 235/493 |
| 4,510,489 | 4/1985 | Anderson, III et al. | 340/572 |
| 4,626,311 | 12/1986 | Taylor | 156/308.2 |
| 4,660,025 | 4/1987 | Humphrey | 340/572 |
| 4,686,154 | 8/1987 | Mejia | 428/611 |
| 4,835,028 | 5/1989 | Dey et al. | 428/67 |
| 4,980,670 | 12/1990 | Humphrey et al. | 340/551 |
| 5,031,756 | 7/1991 | Buzzard et al. | 206/308.2 |
| 5,081,445 | 1/1992 | Gill et al. | 340/572 |
| 5,218,342 | 6/1993 | McCrackin | 340/572 |
| 5,253,821 | 10/1993 | Johnson | 242/348 |

FOREIGN PATENT DOCUMENTS

| | | | |
|---|---|---|---|
| 0214440 | 3/1987 | European Pat. Off. | G08B 13/24 |

*Primary Examiner*—Glen Swann, III

*Attorney, Agent, or Firm*—Robin, Blecker, Daley and Driscoll

[57] ABSTRACT

An inventory of goods is protected from theft by means of electronic article surveillance (EAS) markers integrated with items of the inventory. Each such item has a structural member in which a cavity is integrally formed. A respective magnetostrictive element is housed, free of mechanically clamping constraint, in each cavity. A respective biasing element is located adjacent to the cavity on each such item of inventory. The biasing element provides a magnetic field to bias the respective magnetostrictive element. EAS equipment is provided at a retail store where the inventory is maintained. The EAS equipment generates an alternating electromagnetic interrogation field, and when an item of inventory having the integrated EAS marker is exposed to the interrogation field, the biased magnetostrictive element is excited into mechanical resonance that is detected by the EAS equipment. Alternatively, the integrated EAS marker includes a magnetic element that provides a harmonic signal in response to the interrogation field, and a lubricant coating is provided on the magnetic element to prevent transmission of mechanical stress to the magnetic element.

66 Claims, 6 Drawing Sheets

MAGNETOMECHANICAL EAS COMPONENTS INTEGRATED WITH A RETAIL PRODUCT OR PRODUCT PACKAGING

FIELD OF THE INVENTION

This invention relates to electronic article surveillance (EAS) systems, and particularly to EAS systems which operate by detecting mechanical resonance of magnetostrictive elements.

BACKGROUND OF THE INVENTION

It is well known to provide electronic article surveillance systems to prevent or deter theft of merchandise from retail establishments. In a typical system, markers designed to interact with an electromagnetic or magnetic field placed at the store exit are secured to articles of merchandise. If a marker is brought into the field or "interrogation" zone, the presence of the marker is detected and an alarm is generated. Some markers of this type are intended to be removed at the checkout counter upon payment of the merchandise. Other types of markers are deactivated upon checkout by a deactivation device which changes an electromagnetic or magnetic characteristic of the marker so that the marker will no longer be detectable at the interrogation zone.

It is a common practice for the presence of the marker to be detected in the interrogation zone by detecting a signal reradiated by the marker in response to the field present in the interrogation zone. For example, U.S. Pat. No. 4,063,229 issued to Welsh et al., discloses several types of markers which generate harmonic signals in response to an alternating field provided in the interrogation zone. The Welsh et al. patent suggests that such markers may be integrated with a price label adhesively attached to an article of merchandise or that one or more markers may be imbedded or incorporated in the packaging for the article or in the article itself.

Other types of harmonic EAS systems are based on markers which include a thin strip or wire of magnetic material that responds to an alternating interrogation signal by generating a signal pulse that is rich in high harmonics of the interrogation signal. Such markers are disclosed in U.S. Pat. No. 4,660,025 to Humphrey and U.S. Pat. No. 4,980,670 to Humphrey et al.

Another type of EAS system employs magnetomechanical markers that include a magnetostrictive element. For example, U.S. Pat. No. 4,510,489, issued toAnderson et al., discloses a marker formed of a ribbon-shaped length of a magnetostrictive amorphous material contained within a hollow recess in an elongated housing in proximity to a biasing magnetic element. The magnetostrictive element is fabricated such that it is mechanically resonant at a predetermined frequency when the biasing element has been magnetized to a certain level. At the interrogation zone, a suitable oscillator provides an AC magnetic field at the predetermined frequency, and the magnetostrictive element mechanically resonates at this frequency upon exposure to the field when the biasing element has been magnetized to the aforementioned level. The resulting signal radiated by the magnetostrictive element is detected by detecting circuitry provided at the interrogation zone. The Anderson et al. patent points out the need to form the housing for the marker so that the mechanical resonance of the magnetostrictive element is not mechanically damped. Anderson et al. also teach that the marker should be formed so that the biasing magnet does not mechanically interfere with the vibration of the magnetostrictive element. The disclosure of the Anderson et al. '489 patent is incorporated herein by reference.

EAS systems which use magnetomechanical markers have proved to be very effective and are in widespread use. Systems of this type are sold by the assignee of this application under the brand name "Ultra*Max". In operating such systems, it is customary to attach magnetostrictive markers to the items of merchandise at retail stores which maintain equipment for generating the field for the interrogation zone. The attachment of the markers to the items of merchandise is typically carried out by means of a pressure sensitive adhesive layer provided on the marker, or, when the marker is intended to be removable, by a mechanical clamping device or the like. One example of such a device is disclosed in U.S. Pat. No. 5,031,756, issued to Buzzard et al., which is directed to a "keeper" which may be utilized in a retail store. The keeper includes a frame for holding a compact disk or similar item, and the compact disk may be locked within the frame to prevent removal of the compact disk from the keeper until the compact disk is paid for at a checkout counter. The keeper disclosed by Buzzard et al. includes an EAS marker which may be a magnetomechanical marker of the type described in the Anderson et al. patent.

In order to improve the efficiency of operation of retail establishments, it has been proposed that EAS markers, including magnetomechanical markers, be applied to the items of merchandise before shipment to the retail establishment. For example, it has been proposed that markers be attached to the goods by manufacturers thereof. This practice has been called "source tagging," which means that an EAS marker or "tag" is applied to goods at the source of the goods. While conventional techniques for attaching markers to goods, which include attaching markers to goods by means of adhesives, have been proposed for use by manufacturers, it would be desirable to provide still more efficient techniques for "source tagging" goods that will ultimately be subject to electronic article surveillance at a retail establishment. Although the Welsh et al. patent suggests that certain kinds of harmonic signal generating markers could be physically embedded in a product or product packaging, that patent is not concerned with the type of marker used in magnetomechanical EAS systems and does not address how the elements making up such a marker could be embedded in a product without constraining the mechanical resonance of the magnetostrictive element and thereby preventing the marker from operating.

The following U.S. patents also propose incorporation of marker elements within an article to be subjected to electronic surveillance:

- U.S. Pat. No. 3,665,449 to Elder et al., which discloses embedding a ferromagnetic strip in a library book.
- U.S. Pat. No. 4,151,405 to Peterson, which discloses embedding ferromagnetic strips in plastic, paper, wood, aluminum, stainless steel, etc.
- U.S. Pat. No. 4,626,311 to Taylor, which discloses embedding marker elements in a thermoplastic holder which is then fused within a garment.
- U.S. Pat. No. 4,686,154 to Mejia, which discloses concealing a tag within a seam or lining of an article of clothing.
- U.S. Pat. No. 4,835,028 to Dey et al., which discloses a magnetostrictive wire embedded in paper.

However, like the Welsh et al. patent, none of these patents is concerned with magnetomechanical markers and none teaches how the elements of such markers could be embedded in a product without constraining the mechanical resonance of the magnetostrictive element.

Moreover, the prior art also fails to teach how to embed in a product magnetic elements like those disclosed in the above-referenced Humphrey and Humphrey et al. patents. U.S. Pat. No. 4,342,904 proposes a marker structure that includes release sheets surrounding the ferromagnetic material within the marker structure to prevent or minimize transfer of stresses to the ferromagnetic material, because such stresses tend to "cold work" the ferromagnetic material and degrade its magnetic properties. Similarly, it is known to apply a lubricant to the type of magnetic material disclosed in the Humphrey '025 patent before forming a marker by laminating flexible sheets around the material. The lubricant prevents stress from being applied from the surrounding sheets to the magnetic material when the marker including the magnetic material is applied to a product. However, it has not heretofore been recognized that embedding the Humphrey or Humphrey et al. material in a product would also tend to produce stresses on the material that would degrade its performance.

OBJECTS AND SUMMARY OF THE INVENTION

It is accordingly a primary object of the invention to provide a technique for efficiently source tagging articles of merchandise that are to be protected by a magnetomechanical EAS system. It is a further object to incorporate active components of a magnetomechanical EAS marker in an item of merchandise or in the packaging for an item of merchandise.

According to an aspect of the invention, there is provided a method of protecting an inventory of goods from theft, including the steps of forming at least some items of the inventory such that each of those items has a substantially rigid structural member having a cavity integrally formed in the member, housing a respective magnetostrictive element in each of the cavities, providing a respective biasing element located adjacent to each of the cavities, with the biasing element providing a magnetic field to bias the respective magnetostrictive element in the cavity, generating an alternating electromagnetic field at a selected frequency, with the biased magnetostrictive element being mechanically resonant when exposed to the alternating electromagnetic field, and detecting the mechanical resonance of the magnetostrictive element. According to this aspect of the invention, each of the cavities is sized and shaped to house the respective magnetostrictive element without constraining the mechanical resonance of the magnetostrictive element.

According to further aspects of the invention, the structural member including the cavity is a housing which defines a second cavity which encloses functional components of the item of merchandise.

According to other aspects of the invention, the method includes sealing the cavity with a sealing member after housing the magnetostrictive element in the cavity, and providing the biasing element by either affixing the biasing element to an outer surface of the sealing member or printing magnetic ink on the outer surface of the respective sealing member to form a magnetic layer on the outer surface, and then magnetically biasing the magnetic layer. It is also contemplated to form a magnetic layer on the outer surface of the sealing member by other techniques, such as vapor deposition, electro-deposition or sputtering.

According to another aspect of the invention, there is provided a magnetomechanical marker integrated with an article of merchandise to be protected by an electronic article surveillance system, including a structural member of the article having a cavity integrally formed in the member, a magnetostrictive element housed in the cavity, and a biasing element located adjacent to the cavity, with the biasing element being magnetically biased to cause the magnetostrictive element to be mechanically resonant when exposed to an alternating electromagnetic field generated at a selected frequency by the electronic article surveillance system, and with the cavity being sized and shaped to house the magnetostrictive element without constraining the mechanical resonance of the magnetostrictive element.

According to still another aspect of the invention there is provided a wrapping structure for containing during shipment an article appointed for surveillance by a magnetomechanical electronic article surveillance system, including a plurality of walls defining a first cavity for enclosing the article appointed for surveillance, with one of the walls having a second cavity integrally formed therein, a magnetostrictive element housed in the second cavity, and a biasing element located adjacent to the second cavity, with the biasing element being magnetically biased to cause the magnetostrictive element to be mechanically resonant when exposed to an alternating electromagnetic field generated at a selected frequency by the electronic article surveillance system, and with the second cavity being sized and shaped to house the magnetostrictive element without constraining the mechanical resonance of the magnetostrictive element.

According to yet another aspect of the invention, there is provided a magnetomechanical EAS marker integrated with a packing fixture for protecting an article of merchandise from damage during shipment, including a body having a first portion formed to fit a contour of the article of merchandise and a second portion formed to fit a carton in which the article is to be shipped, with the body having a cavity integrally formed therein, a magnetostrictive element housed in the cavity, and a biasing element located adjacent to the cavity and being magnetically biased to cause the magnetostrictive element to be mechanically resonant when exposed to an alternating electromagnetic field generated at a selected frequency by an electronic article surveillance system, with the cavity being sized and shaped to house the magnetostrictive element without constraining the mechanical resonance of the magnetostrictive element.

According to still another aspect of the invention, there is provided a method of verifying the authenticity of an article of merchandise, including the steps of forming a magnetic element selected to provide a signal that is detectable by an electronic article surveillance system, integrating the magnetic element in the article of merchandise, and detecting the presence of the magnetic element integrated in the article of merchandise.

According to a further aspect of the invention, there is provided an article of merchandise to be protected from theft, including a substantially rigid member having incorporated therein a magnetic element selected to provide a signal that is detectable by an electronic article surveillance system, and means for limiting transmission of mechanical stress from the member to the magnetic element.

DESCRIPTION OF THE PREFERRED EMBODIMENTS

Figure 1:
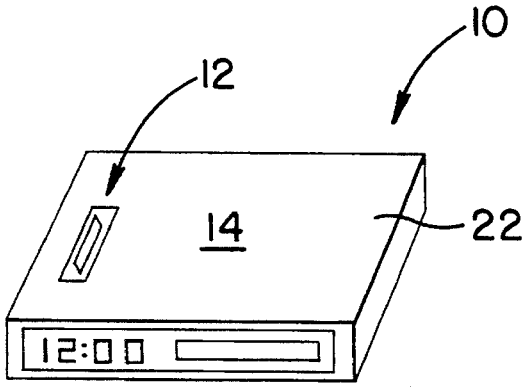
FIG. 1 is a perspective view of an article of merchandise having magnetomechanical electronic article surveillance elements integrated therein in accordance with the invention.
Figure 2:
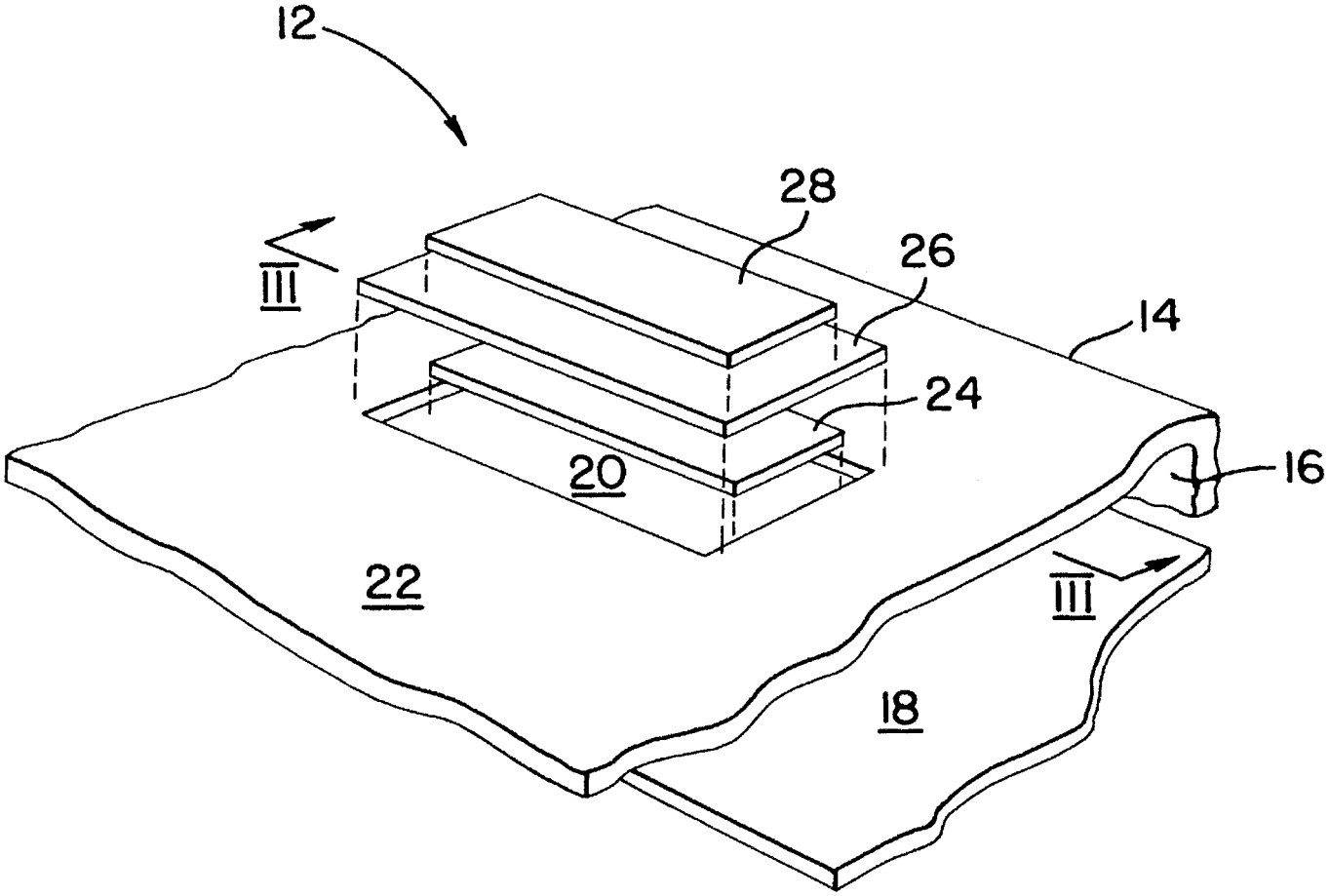
FIG. 2 is an exploded view of a portion of the article of FIG. 1 showing how the EAS elements are integrated in the article of merchandise.

A first embodiment of the invention will now be described with reference to FIGS. 1–4. In FIG. 1, reference numeral 10 generally indicates an article of merchandise (in particular, an electronic consumer appliance) having an integrated magnetomechanical EAS marker portion 12. As best seen in FIG. 2, the article 10 includes a substantially rigid housing 14 in the shape of a box defining a cavity 16 which contains functional components of the article 10 such as a circuit board 18. The housing is formed of a non-magnetic material such as molded plastic.

Another, smaller cavity 20 is integrally formed in a top wall 22 of the housing 14. As seen from FIGS. 2–4, the cavity 20 is shaped and sized to accommodate therein a magnetostrictive element 24. The element 24 may be of the same shape and size as magnetostrictive elements used in conventional stand-alone magnetomechanical markers and may be formed of a conventional material such as the amorphous metal alloy known as Metglas® 2826 MB or any other suitable magnetostrictive material.

Figure 3:
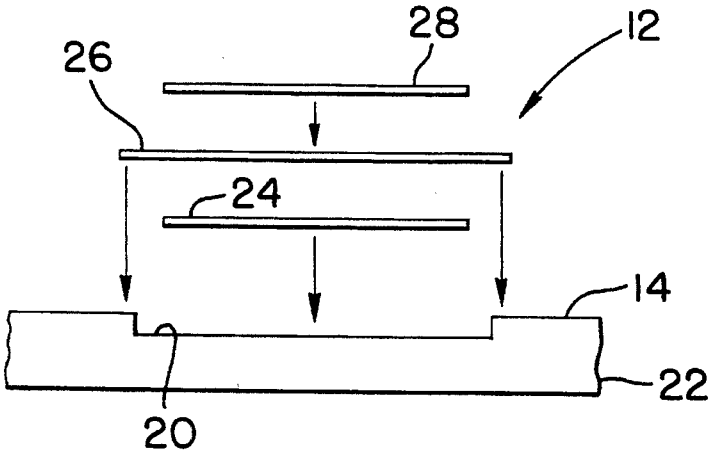
FIG. 3 is a sectional view, taken along the line III—III of FIG. 2, schematically illustrating a process for integrating the EAS elements into the article of FIG. 1.

As somewhat schematically illustrated in FIG. 3, after the element 24 is placed in the cavity 20, the cavity is closed by affixing a sealing member 26 on the outer surface of the wall 22 in a position such that the sealing member 26 overlies the opening of the cavity 20. Like the housing 14, the sealing member 26 should be non-metallic and may be formed, for example, of plastic or paper.

The assembly of the integrated marker portion 12 of the article 10 is completed by mounting a biasing element 28 in a position adjacent to the cavity 20 and the magnetostrictive element 24 housed in the cavity 20. For example, as suggested by FIG. 3, the biasing element 28 may be mounted (by an adhesive, for example) to an outer surface of the sealing member 26. This may be done either before or after the sealing member is affixed to wall 22 of housing 14.

Figure 4:
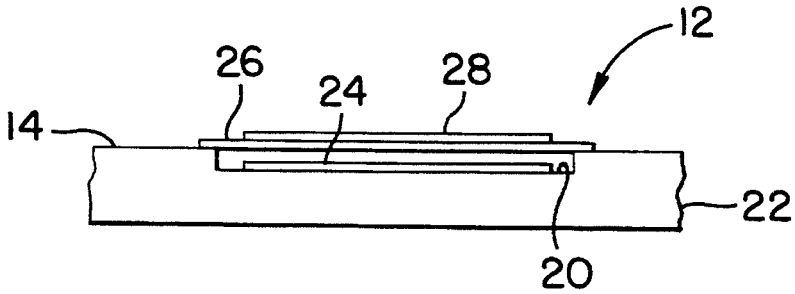
FIG. 4 is a sectional view, similar to FIG. 3 but showing the EAS elements after integration into the article of merchandise.

FIGS. 2–4 show the biasing element 28 in the form of a strip of magnetic material which has a higher coercivity than the magnetostrictive element 24, and which is of the type provided in conventional free-standing magnetomechanical markers. However, according to an alternative embodiment of the invention, the biasing element 28 may be formed as a layer of magnetic ink, printed on the outer surface of the sealing member 26 or at another suitable location adjacent to the cavity 20. Alternatively, the biasing element 28 may be formed as a suitable layer of material provided by processes such as vapor deposition, electro-deposition or sputtering. Again, the layer constituting the biasing element 28 may be formed on the sealing member 26 either before or after attachment of the sealing member 26 to the wall 22 of housing 14.

As is the case with free-standing markers, magnetization of the biasing element 28 to provide the necessary biasing field may be performed either before or after assembly of the components 24 and 28 into the integrated marker portion 12 of the article 10.

FIGS. 4A–4D illustrate in flow-diagram form processes that may be used in accordance with the invention to form the biasing element 28 on the sealing member 26.

Figure 4A:
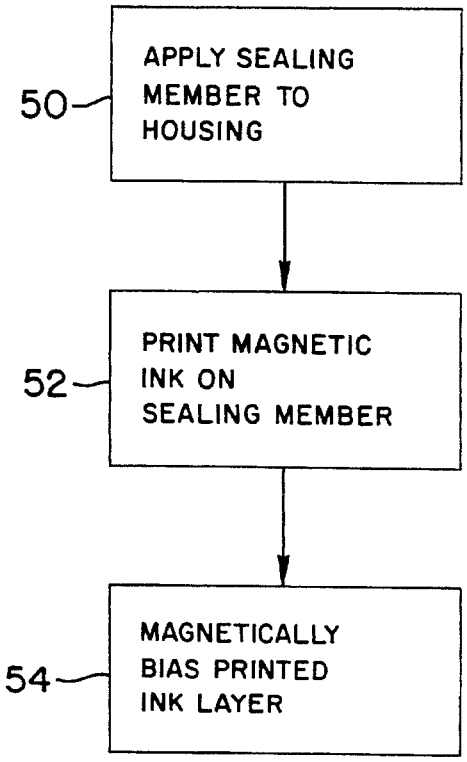
FIGS. 4A–4D are flow diagrams which illustrate processes for forming a biasing element on a cavity sealing member.

According to the process illustrated in FIG. 4A, the sealing member 28 is first attached to the housing 14 so as to close the cavity 20 (step 50). Then a layer of magnetic ink is printed on the outer surface of the sealing member 26 (step 52) and the layer of magnetic ink is magnetized (step 54).

Figure 4C:
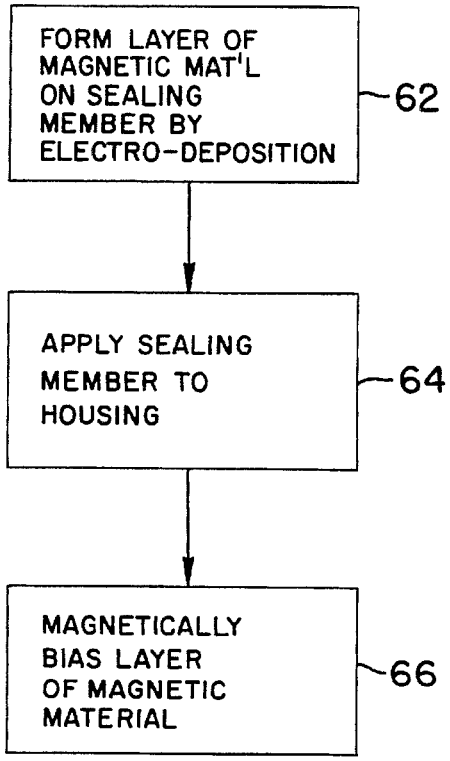
Figure 4B:
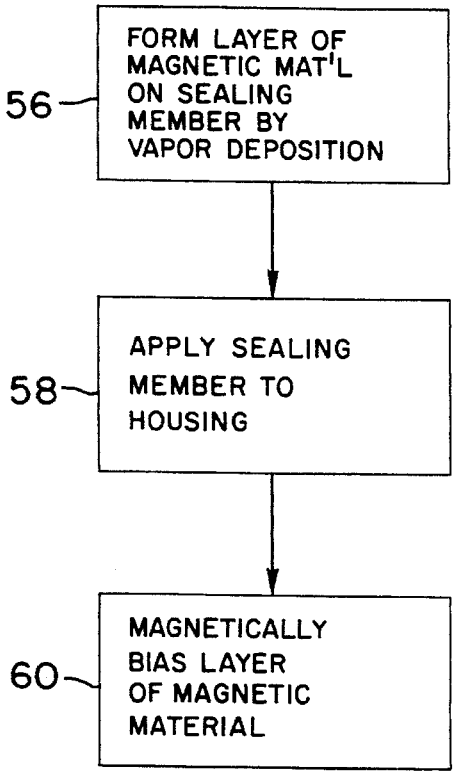

According to the process illustrated in FIG. 4B, a layer of magnetic material is formed on a surface of the sealing member 26 by vapor deposition (step 56), and then the sealing member 26 is applied to the housing 14 to close the cavity 20 (step 58). Then the layer of magnetic material is magnetized (step 60).

According to the process illustrated in FIG. 4C, a layer of magnetic material is formed on a surface of the sealing member 26 by electro-deposition (step 62), and then the sealing member 26 is attached to the housing 14 so as to close the cavity 20 (step 64). Finally, the layer of magnetic material is magnetized (step 66).

Figure 4D:
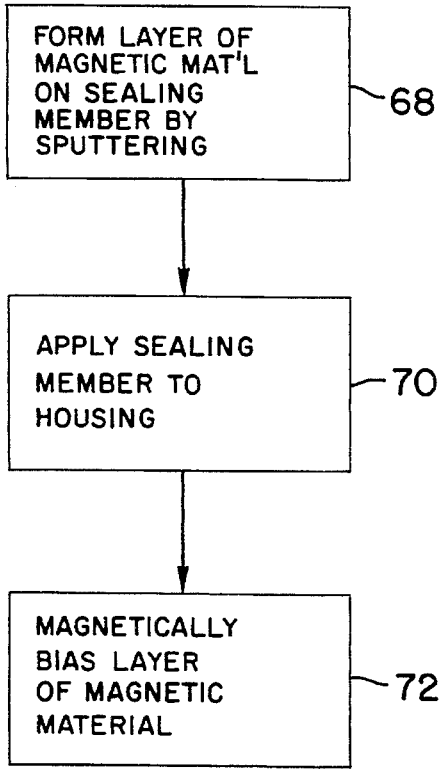

According to the process illustrated in FIG. 4D, a layer of magnetic material is formed on a surface of sealing member 26 by sputtering (step 68), and then the sealing member 26 is attached to the housing 14 so as to close the cavity 20 (step 70). Finally, the layer of magnetic material is magnetized (step 72).

It will be recognized that the sealing member 26, in addition to retaining the magnetostrictive element 24 in the cavity 20, also serves as a spacer between the magnetostrictive element 24 and the biasing element 28, so that the biasing element 28, when magnetized, does not "clamp" the magnetostrictive element 24 and thereby prevent the magnetostrictive element 24 from exhibiting the desired mechanical resonance upon exposure to an interrogation field.

FIG. 4 illustrates the integrated marker portion 12 in its final assembled form. It should be noted that in the drawing the thickness of the elements 24, 26, and 28 has been exaggerated for clarity of illustration. In actual practice, the magnetostrictive element 24, the sealing member 26 and the biasing element 28 may all be made quite thin, particularly if the biasing element is formed of magnetic ink, so that the integrated marker portion 12 is nearly flush with the upper surface of the housing 14. The cavity 20 is dimensioned so that the magnetostrictive element 28 can exhibit mechanical resonance upon exposure to a suitable interrogation field without being constrained by the walls of the cavity 20.

It will be appreciated that an integrated marker portion 12 as illustrated in FIGS. 3 and 4 can be incorporated in many types of articles of merchandise besides electronic appliances. It is also possible to integrate the marker portion 12 within a structural element of an article of merchandise other than the housing of the article. By way of example, an integrated marker portion could be included in the handle of a hand tool, in the protective case of a recording medium such as a compact disk or a magnetic tape, or in the carrying strap of an article of luggage.

Activation and deactivation of the integrated marker portion 12 can be performed according to conventional techniques. For example, deactivation may be carried out by placing the article 10, or at least the integrated marker portion 12 thereof, within a magnetic field provided for degaussing the biasing element 28.

Figure 5:
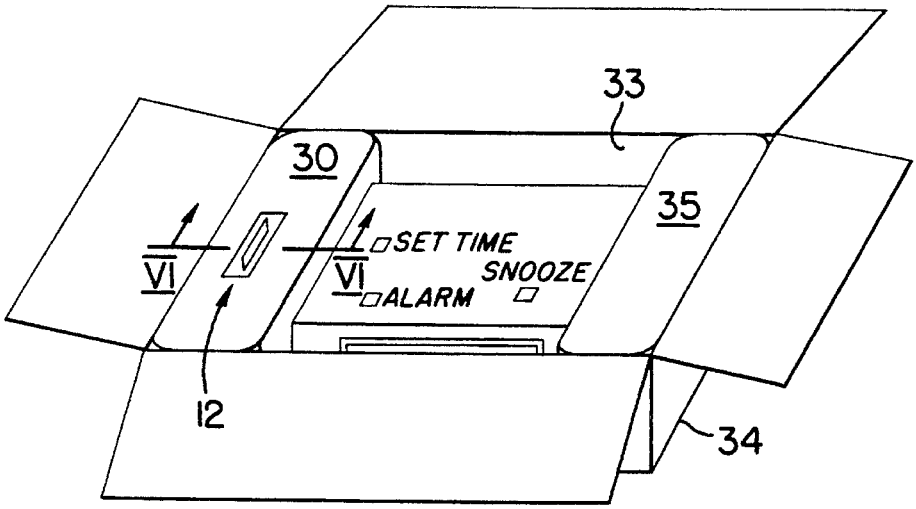
FIG. 5 is a perspective view of an article of merchandise packed in shipping carton with use of a packing fixture which has magnetomechanical EAS elements integrated in the fixture in accordance with the invention.
Figure 6:
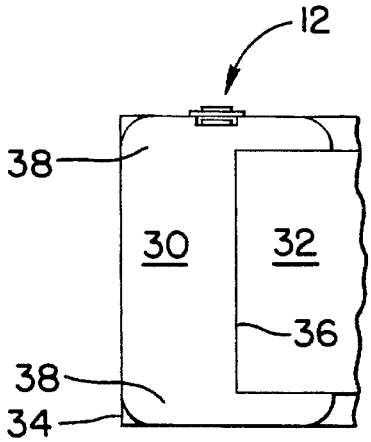
FIG. 6 is a sectional view taken at line VI—VI of FIG. 5 showing additional details of the packing fixture having EAS elements integrated therein.

According to other embodiments of the invention, one or more integrated marker portions 12 may be provided in packing materials provided for protecting an article of merchandise from damage during shipment. For example, as shown in FIG. 5, an integrated marker portion 12 is provided in a packing fixture 30, in the form of a molded plastic foam block which is used in cooperation with a second foam block packing fixture 35 to securely nest an article of merchandise 32 in the interior 33 of a packing carton 34. As best seen in FIG. 6, the packing fixture 30 includes an inner portion 36 which is formed to fit the contour of the article 32 and an outer portion 38 formed to fit the carton 34. The integrated marker portion 12 of the packing fixture 30 may be the same as the marker portion illustrated in FIGS. 4 and 5 and discussed above. Alternatively, for example, parallel deep narrow slots may be provided extending into the body of packing fixture 30 for accommodating therein the magnetostrictive element 24 and the biasing element 28.

It should be understood that the size and shape of the packing fixture 30 having the integrated magnetomechanical EAS marker is subject to variation depending on the respective sizes and shapes of the packing carton and the article of merchandise to be nested in the carton. For example, rather than using a pair of cooperating fixtures as shown in FIG. 5, there may be provided only a single fixture 30 (with an integrated marker portion 12), shaped to have the article of merchandise nested in the fixture 30. It should also be recognized that the fixture 30 may be formed of other suitable materials, such as cardboard, instead of plastic foam.

Figure 7:
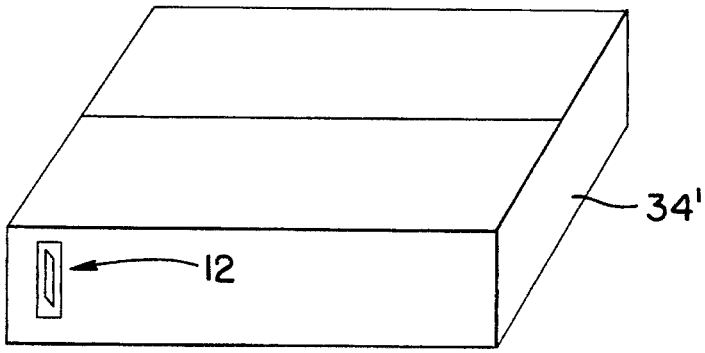
FIG. 7 is perspective view of a shipping carton having magnetomechanical EAS elements integrated therein in accordance with the invention.

According to another embodiment of the invention, as shown in FIG. 7, a packing carton 34' is provided with an integrated marker portion 12 like that shown in FIGS. 3 and 4. Like the carton 34 of FIG. 5, it will be recognized that the carton 34' includes walls which define a large cavity 33 (FIG. 5, not shown in FIG. 7), for enclosing an article of merchandise 32 for shipment within the carton 34'. As before, the integrated marker portion 12 includes a small cavity 20 (FIGS. 3 and 4, not shown in FIG. 7) shaped and sized to accommodate a magnetostrictive element 24 without constraining mechanical resonance of the magnetostrictive element.

It is to be appreciated that integration of magnetostrictive EAS marker elements into a product or product packaging, as disclosed above, relieves the retailer from the labor-intensive task of applying stand-alone markers to an inventory of goods, and that the formation of the cavity for the magnetostrictive element and the installation of the marker components in the product or product wrapping can be efficiently incorporated in the manufacturing process.

Figure 8:
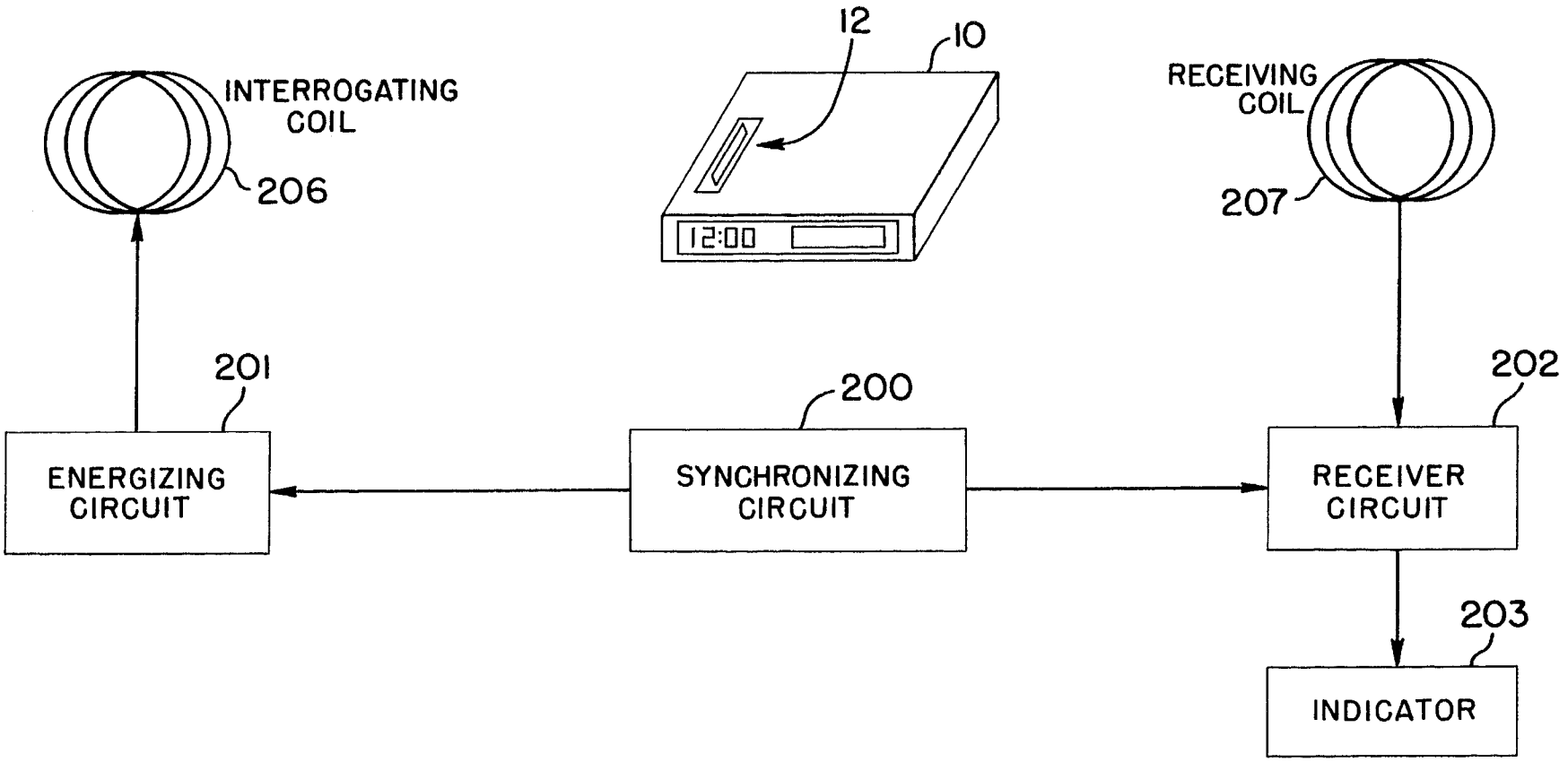
FIG. 8 is a schematic block diagram of an electronic article surveillance system used in conjunction with the integrated article of merchandise and magnetomechanical EAS marker of FIG. 1.

FIG. 8 illustrates a magnetomechanical system used for detecting unauthorized passage through an interrogation zone of an article of merchandise that has an integrated marker portion or that is wrapped in a wrapping structure or with a packing fixture having an integrated marker portion.

The system shown in FIG. 8 includes a synchronizing circuit 200 which controls the operation of an energizing circuit 201 and a receiving circuit 202. The synchronizing circuit 200 sends a synchronizing gate pulse to the energizing circuit 201, and the synchronizing gate pulse activates the energizing circuit 201. Upon being activated, the energizing circuit 201 generates and sends an interrogation signal to interrogating coil 206 for the duration of the synchronizing pulse. In response to the interrogation signal, the interrogating coil 206 generates an interrogating magnetic field, which, in turn, excites the integrated marker portion 12 of the article of merchandise 10 into mechanical resonance.

Upon completion of the pulsed interrogating signal, the synchronizing signal 200 sends a gate pulse to the receiver circuit 202, and the latter gate pulse activates the circuit 202. During the period that the circuit 202 is activated, and if an active marker is present in the interrogating magnetic field, such marker will generate in the receiver coil 207, a signal at the frequency of mechanical resonance of the marker. This signal is sensed by the receiver 202, which responds to the sensed signal by generating a signal to an indicator 203 to generate an alarm or the like. In short, the receiver circuit 202 is synchronized with the energizing circuit 201 so that the receiver circuit 202 is only active during quiet periods between the pulses of the pulsed interrogation field.

Although FIG. 8 illustrates use of the integrated article of merchandise and EAS marker in connection with a pulsed-interrogation type of magnetomechanical EAS system, it is also contemplated to use such integrated article of merchandise and marker with a swept-frequency magnetomechanical system like that disclosed in the above-referenced U.S. Pat. No. 4,510,489, or any other system designed to operate with magnetomechanical markers.

Another embodiment of the invention provides an integrated article of merchandise and EAS marker suitable for surveillance by a harmonic EAS system. This embodiment may be like the embodiment described above in connection with FIGS. 1–4 with the following differences: (a) no biasing element 28 needs to be provided, and (b) the magnetostrictive element 24 is replaced by a magnetic wire or strip of a type disclosed in the Humphrey U.S. Pat. No. 4,660,025 or the Humphrey et al. U.S. Pat. No. 4,980,670 patents referred to above. Also, the cavity 20 in this embodiment is shaped and sized so that the magnetic wire or strip is permitted to move within the cavity. It is to be noted that such a cavity serves to prevent or limit transfer of mechanical stress from the housing 14 to the magnetic wire or strip. Accordingly, the magnetic wire or strip does not suffer the degradation of its magnetic properties that would occur if the wire or strip were simply embedded in the housing 14.

It will be recognized that variations of this embodiment may be provided in which the magnetic wire or strip is integrated with a packing fixture like that of FIGS. 5 and 6, or in a packing carton like that shown in FIG. 7.

Figure 9:
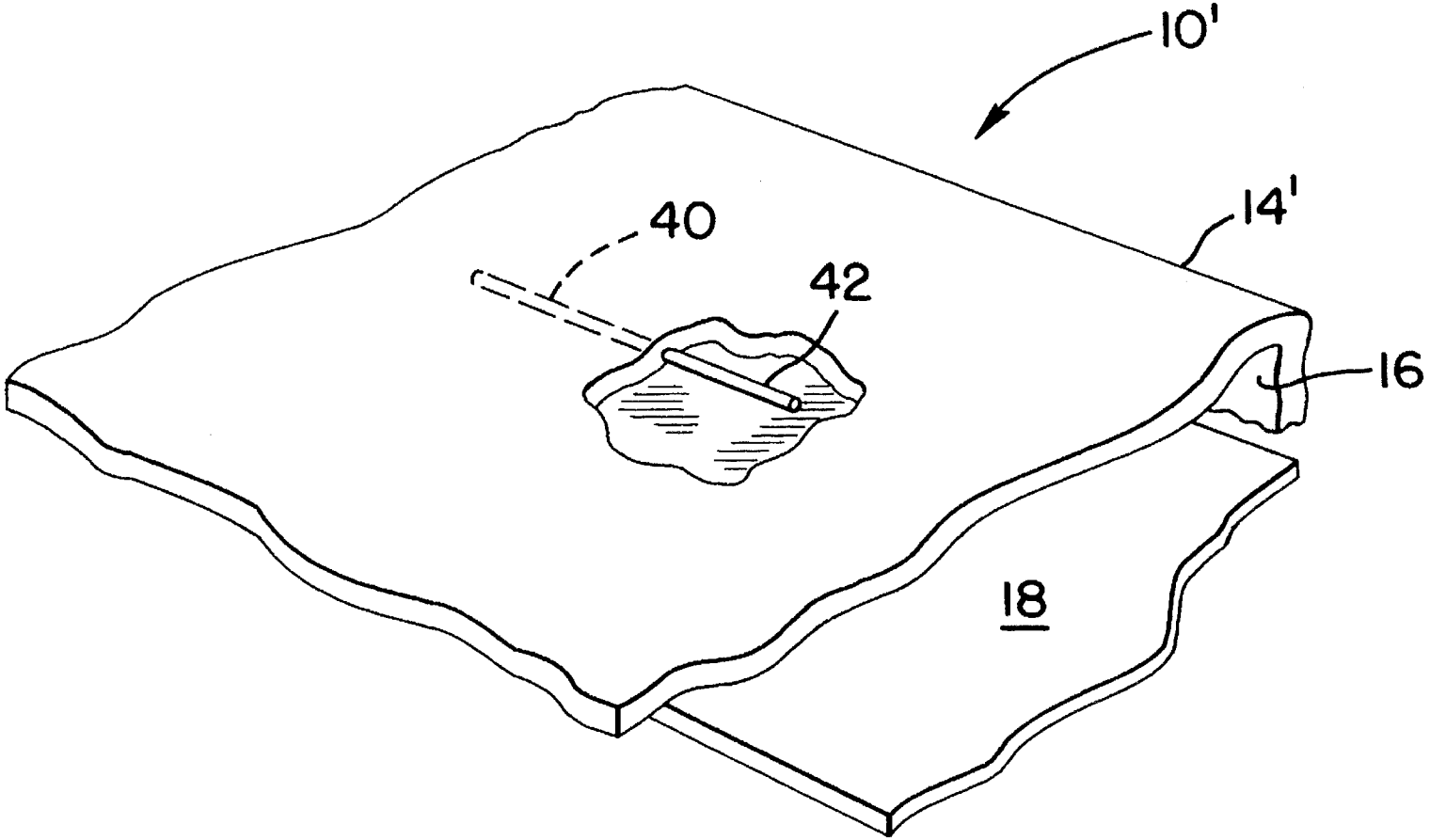
FIG. 9 is a perspective view, partially broken away, of a portion of an article of merchandise having a magnetic wire embedded therein in accordance with another embodiment of the invention.

Another embodiment of the invention is illustrated in FIG. 9. According to this embodiment, a magnetic wire 40 (of the Humphrey or Humphrey et al. type, for example) is directly embedded in the housing 14' of an article 10'. For example, the housing 14' may be of plastic and formed by molding around the wire 40. A lubricant coating 42, including silicone for example, is applied to the wire 40 before it is embedded in the housing 14'. The coating 42 serves to eliminate or limit mechanical stress that would otherwise be applied to the wire 42 during the process of molding the housing 14'. Again, this embodiment may be varied by embedding a lubricant-coated wire in a packing fixture or shipping carton, for example.

Up to this point there have been described theft-deterrence or theft-detection uses of articles of merchandise, wrapping structures, and so forth having EAS components integrated therein. However, other uses of such items are also contemplated. For example, the presence of an integrated marker portion or an embedded marker element in an article of merchandise may be detected to verify the authenticity of the article of merchandise.

More specifically, it is not uncommon for certain kinds of merchandise, such as compact discs or magnetic tapes, to be "pirated," i.e., duplicated by unauthorized persons and packaged so as to resemble authorized copies of musical or audio-visual works. The pirated CDs or tapes may then be distributed through normal retail channels, often without the knowledge of legitimate retail establishments that would not knowingly sell pirated goods.

In order to prevent or deter distribution of pirated goods through legitimate channels, sales of magnetic and magnetomechanical EAS components can be limited to legitimate manufacturers who embed or incorporate the components in, e.g., the protective cases of CDs or magnetic tapes. Retailers can then verify the authenticity of the goods by detecting the presence of the integrated or embedded EAS components in the goods. For this purpose, a suitable detection system, similar to a conventional EAS system, may be provided at the stock room or on the shipping dock. Alternatively, the presence of the EAS components may simply be detected by visual inspection in cases where the EAS components are integrated at visually accessible portions of the goods.

Various other changes in the foregoing articles and modifications in the described practices may be introduced without departing from the invention. The particularly preferred embodiments of the invention are thus intended in an illustrative and not limiting sense. The true spirit and scope of the invention is set forth in the following claims.

What is claimed is:

1. A method of protecting an inventory of goods from theft, comprising the steps of:

(a) forming at least some items of said inventory such that each of said at least some items has a member having a cavity integrally formed in said member;

(b) housing a respective magnetostrictive element in each said cavity;

(c) providing a respective biasing element located adjacent to and outside of each said cavity, said biasing element for providing a magnetic field to bias the respective magnetostrictive element in each said cavity;

(d) generating an alternating electromagnetic field at a selected frequency, said biased magnetostrictive element being mechanically resonant when exposed to said alternating electromagnetic field; and (e) detecting said mechanical resonance of said magnetostrictive element;

each said cavity being sized and shaped to house the respective magnetostrictive element without constraining the mechanical resonance of the magnetostrictive element.

2. A method according to claim wherein said step of providing the respective biasing element includes printing magnetic ink adjacent the respective cavity.

3. A method according to claim 1, wherein the said member of said at least some of said items is a housing for defining a second cavity which encloses functional components of said at least some of said items.

4. A method according to claim 1, further comprising the step of sealing each said cavity with a respective sealing member after housing said respective magnetostrictive element in said cavity.

5. A method according to claim 4, wherein said step of providing said respective biasing element includes affixing said respective biasing element to an outer surface of said respective sealing member.

6. A method according to claim 4, wherein said step of providing said respective biasing element includes forming a magnetic layer on an outer surface of said respective sealing member and magnetically biasing said magnetic layer.

7. A method according to claim 6, wherein said forming of said magnetic layer on said outer surface of said sealing member includes a process selected from the group consisting of printing with magnetic ink, vapor deposition, electrodeposition, and sputtering.

8. A method of manufacturing an article to be sold in a retail store, comprising the steps of:

(a) forming a member of the article so that a cavity is integrally provided in said member;

(b) housing a magnetostrictive element in said cavity; and (c) providing a biasing element located adjacent to and outside of said cavity, said biasing element, when magnetically biased, for causing said magnetostrictive element to be mechanically resonant when exposed to an alternating electromagnetic field generated at a selected frequency by an electronic article surveillance system;

said cavity being shaped and sized to house said magnetostrictive element without constraining said mechanical resonance of said magnetostrictive element.

9. A method according to claim 8, wherein said step of providing the biasing element includes forming a magnetic layer adjacent the cavity.

10. A method according to claim 9, wherein said forming of said magnetic layer adjacent the cavity includes a process selected from the group consisting of printing with magnetic ink, vapor deposition, electro-deposition, and sputtering.

11. A method according to claim 8, wherein said member is a housing for defining a second cavity which encloses functional components of said article.

12. An article of merchandise to be protected from theft, the article comprising a member having a cavity formed integrally in said member, a magnetostrictive element housed in said cavity, and a biasing element located adjacent to and outside of said cavity, said biasing element, when magnetically biased, for causing said magnetostrictive element to be mechanically resonant when exposed to an alternating electromagnetic field generated at a selected frequency by an electronic article surveillance system, said cavity being shaped and sized to house said magnetostrictive element without constraining said mechanical resonance of said magnetostrictive element.

13. An article according to claim 12, wherein said biasing element comprises a layer of magnetic material formed adjacent to said cavity.

14. An article according to claim 13, wherein said layer of magnetic material is formed by a process selected from the group consisting of printing with magnetic ink, vapor deposition, electro-deposition, and sputtering.

15. An article according to claim 12, wherein said member is a housing for defining a second cavity which encloses functional components of said article.

16. An article according to claim 12, further comprising a sealing member positioned for sealing said cavity.

17. An article according to claim 16, wherein said biasing element comprises a layer of magnetic material formed on an outer surface of said sealing member.

18. An article according to claim 17, wherein said layer of magnetic material is formed by a process selected from the group consisting of printing with magnetic ink, vapor deposition, electro-deposition, and sputtering.

19. A magnetomechanical electronic article surveillance system for protecting an inventory of goods from theft, comprising:

(a) generating means for generating a magnetic field alternating at a selected frequency in an interrogation zone;

(b) an item of said inventory of goods, said item including a member having a cavity formed integrally in said member, a magnetostrictive element housed in said cavity, and a biasing element located adjacent to and outside of said cavity, said biasing element being magnetically biased to cause said magnetostrictive element to be mechanically resonant when exposed to said alternating field, said cavity being sized and shaped to house said magnetostrictive element without constraining said mechanical resonance of said magnetostrictive element; and (c) detecting means for detecting said mechanical resonance of said magnetostrictive element.

20. A magnetomechanical electronic article surveillance system according to claim 19, wherein said biasing element comprises a layer of magnetic material formed adjacent to said cavity.

21. A magnetomechanical electronic article surveillance system according to claim 20, wherein said layer of magnetic material is formed by a process selected from the group consisting of printing with magnetic ink, vapor deposition, electrodeposition, and sputtering.

22. A magnetomechanical electronic article surveillance system according to claim 19, wherein said member is a housing for defining a second cavity which encloses functional components of said item of said inventory.

23. A magnetomechanical marker integrated with an article of merchandise to be protected by an electronic article surveillance system, comprising:

(a) a member of said article having a cavity integrally formed in said member;

(b) a magnetostrictive element housed in said cavity; and (c) a biasing element located adjacent to and outside of said cavity, said biasing element, when magnetically biased, for causing said magnetostrictive element to be mechanically resonant when exposed to an alternating electromagnetic field generated at a selected frequency by said electronic article surveillance system;

said cavity being sized and shaped to house said magnetostrictive element without constraining said mechanical resonance of said magnetostrictive element.

24. An integrated marker and article of merchandise according to claim 23, wherein said biasing element comprises a layer of magnetic material formed adjacent to said cavity.

25. An integrated marker and article of merchandise according to claim 24, wherein said layer of magnetic material is formed by a process selected from the group consisting of printing with magnetic ink, vapor deposition, electro-deposition, and sputtering.

26. An integrated marker and article of merchandise according to claim 23, wherein said member of said article is a housing for defining a second cavity which encloses functional components of said article.

27. A wrapping structure for containing during shipment an article appointed for surveillance by a magnetomechanical electronic article surveillance system, comprising:

(a) a plurality of walls defining a first cavity for enclosing said article appointed for surveillance, one of said walls having a second cavity integrally formed therein;

(b) a magnetostrictive element housed in said second cavity; and (c) a biasing element located adjacent to said second cavity, said biasing element, when magnetically biased, for causing said magnetostrictive element to be mechanically resonant when exposed to an alternating electromagnetic field generated at a selected frequency by said electronic article surveillance system;

said second cavity being sized and shaped to house said magnetostrictive element without constraining said mechanical resonance of said magnetostrictive element.

28. A wrapping structure according to claim 27, wherein said biasing element comprises a layer of magnetic material formed adjacent to said cavity.

29. A wrapping structure according to claim 28, wherein said layer of magnetic material is formed by a process selected from the group consisting of printing with magnetic ink, vapor deposition, electro-deposition, and sputtering.

30. A wrapping structure according to claim 27, further comprising a sealing member positioned for sealing said cavity.

31. A wrapping structure according to claim 30, wherein said biasing element comprises a layer of magnetic material formed on an outer surface of said sealing member.

32. A magnetomechanical electronic article surveillance system for protecting an inventory of goods from theft, comprising:

(a) generating means for generating a magnetic field alternating at a selected frequency in an interrogation zone;

(b) an item of said inventory of goods, said item including an article of merchandise and a wrapping structure for said article of merchandise, said wrapping structure including a plurality of walls defining a first cavity in which said article of merchandise is enclosed, one of said walls having a second cavity integrally formed therein, said wrapping structure also including a magnetostrictive element housed in said second cavity and a biasing element located adjacent to said second cavity, said biasing element being magnetically biased to cause said magnetostrictive element to be mechanically resonant when exposed to said alternating field, said second cavity being sized and shaped to house said magnetostrictive element without constraining said mechanical resonance of said magnetostrictive element; and (c) detecting means for detecting said mechanical resonance of said magnetostrictive element.

33. A magnetomechanical electronic article surveillance system according to claim 32, wherein said biasing element comprises a layer of magnetic material formed adjacent to said second cavity.

34. A magnetomechanical EAS marker integrated with a packing fixture for protecting an article of merchandise from damage during shipment, comprising:

(a) a body having a first portion formed to fit a contour of said article of merchandise and a second portion formed to fit a carton in which said article is to be shipped, said body having a cavity integrally formed therein;

(b) a magnetostrictive element housed in said cavity; and (c) a biasing element located adjacent to said cavity, said biasing element, when magnetically biased, for causing said magnetostrictive element to be mechanically resonant when exposed to an alternating electromagnetic field generated at a selected frequency by an electronic article surveillance system;

said cavity being sized and shaped to house said magnetostrictive element without constraining said mechanical resonance of said magnetostrictive element.

35. An integrated EAS marker and packing fixture according to claim 34, wherein said biasing element comprises a layer of magnetic material formed adjacent to said cavity.

36. An integrated EAS marker and packing fixture according to claim 35, wherein said layer of magnetic material is formed by a process selected from the group consisting of printing with magnetic ink, vapor deposition, electro-deposition, and sputtering.

37. An integrated EAS marker and packing fixture according to claim 36, wherein said body is formed of molded plastic foam.

38. A magnetomechanical electronic article surveillance system for protecting an inventory of goods from theft, comprising:

(a) generating means for generating a magnetic field alternating at a selected frequency in an interrogation zone;

(b) an item of said inventory of goods, said item including a packing fixture, an article of merchandise supported in said packing fixture, and a carton containing said packing fixture and said article of merchandise, said packing fixture including a body having a first portion formed to fit a contour of said article of merchandise and a second portion formed to fit said carton, said body having a cavity integrally formed therein, said packing fixture also including a magnetostrictive element housed in said cavity and a biasing element located adjacent to said cavity, said biasing element being magnetically biased to cause said magnetostrictive element to be mechanically resonant when exposed to said alternating field, said cavity being sized and shaped to house said magnetostrictive element without constraining said mechanical resonance of said magnetostrictive element; and (c) detecting means for detecting said mechanical resonance of said magnetostrictive element.

39. A magnetomechanical electronic article surveillance system according to claim 38, wherein said biasing element comprises a layer of magnetic material formed adjacent to said cavity.

40. A magnetomechanical electronic article surveillance system according to claim 38, wherein said body of said packing fixture is formed of molded plastic foam.

41. A method of verifying the authenticity of an article of merchandise, comprising the steps of:

forming a magnetic element that is a magnetostrictive element selected to provide a signal that is detectable by a magnetomechanical electronic article surveillance system;

integrating said magnetic element into said article of merchandise by forming a member of the article so that a cavity is integrally provided in said member, housing the magnetic element in said cavity, and providing a biasing element located adjacent to and outside of said cavity, said biasing element when magnetically biased, for causing said magnetic element to be mechanically resonant when exposed to an alternating electromagnetic field generated at a selected frequency by said magnetomechanical electronic article surveillance system, said cavity being shaped and sized to house said magnetic element without constraining said mechanical resonance of said magnetic element; and detecting the presence of said magnetic element integrated in said article of merchandise.

42. A method according to claim 41, wherein said detecting step includes exposing said article of merchandise to an interrogation signal and detecting a response signal generated by said magnetic element in response to said interrogation signal.

43. A method according to claim 41, wherein said detecting step includes visual inspection of said article of merchandise.

44. A method of verifying the authenticity of an article of merchandise, comprising the steps of:

forming a magnetic element selected to provide a signal that is detectable by an electronic article surveillance system which generates an interrogation signal at a predetermined frequency, said magnetic element responding to said interrogation signal by generating a response signal that includes substantial harmonics of said predetermined frequency;

providing a lubricant coating on said magnetic element;

embedding said magnetic element With said lubricant coating directly into a member of said article of merchandise by forming said member of a material molded around said magnetic element with said lubricant coating; and detecting the presence of said magnetic element embedded in said article of merchandise.

45. A method according to claim 44, wherein said material molded around said magnetic element is plastic.

46. An article of merchandise to be protected from theft, the article comprising a member formed of a molded material having directly embedded therein a magnetic element selected to provide a signal that is detectable by an electronic article surveillance system, said magnetic element having a lubricant coating thereon for limiting transmission of mechanical stress from said member to said magnetic element.

47. An article according to claim 46, wherein said molded material is plastic.

48. An article according to claim 46, wherein said magnetic element is selected to respond to an alternating EAS interrogation signal by generating a signal pulse which includes harmonics of the interrogation signal.

49. An article according to claim 46, wherein said member in which said magnetic element is embedded is a housing for defining a cavity which encloses functional components of said article.

50. A method of manufacturing an article to be sold in a retail store, comprising the steps of:

forming a magnetic element selected to provide a signal that is detectable by an electronic article surveillance system;

providing a lubricant coating on said magnetic element; and embedding said magnetic element with said lubricant coating directly into a member of said article by forming said member of a material molded around said magnetic element with said lubricant coating.

51. A method according to claim 50, wherein said material molded around said magnetic element is plastic.

52. A method according to claim 50, wherein said magnetic element is selected to respond to an alternating EAS interrogation signal by generating a signal pulse which includes harmonics of the interrogation signal.

53. A method according to claim 50, wherein said member in which said magnetic element is embedded is a housing for defining a cavity which encloses functional components of said article.

54. An electronic article surveillance system for protecting an inventory of goods from theft, comprising:

(a) generating means for generating a magnetic field alternating at a selected frequency in an interrogation zone;

(b) an item of said inventory of goods, said item including a member formed of a molded material and having embedded directly therein a magnetic element having a lubricant coating for limiting transmission of mechanical stress from said member to said magnetic element, said magnetic element being selected to provide a signal that is detectable by said electronic article surveillance system; and (c) detecting means for detecting harmonic signals generated by said magnetic element in response to said alternating magnetic field.

55. An electronic article surveillance system according to claim 54, wherein said molded material is plastic.

56. An electronic article surveillance system according to claim 54, wherein said magnetic element, upon exposure to said magnetic field generated by said generating means, generates a signal pulse which includes harmonics of said selected frequency.

57. An electronic article surveillance system according to claim 54, wherein said member in which said magnetic element is embedded is a housing for defining a cavity which encloses functional components of said article.

58. A wrapping structure for containing during shipment an article appointed for surveillance by an electronic article surveillance system, comprising:

(a) a plurality of walls defining a first cavity for enclosing said article appointed for surveillance;

(b) a magnetic element selected to provide a signal that is detectable by said electronic article surveillance system and incorporated into one of said plurality of walls; and (c) means for limiting transmission of mechanical stress from said one of said plurality of walls to said magnetic element.

59. A wrapping structure according to claim 58, wherein said means for limiting transmission of mechanical stress comprises a lubricant coating on said magnetic element.

60. A wrapping structure according to claim 58, wherein said means for limiting transmission of mechanical stress comprises a second cavity integrally formed in said one of said plurality of walls and shaped and sized to house said magnetic element therein so that said magnetic element is permitted to move within said second cavity.

61. An EAS marker integrated with a packing fixture for protecting an article of merchandise from damage during shipment, comprising:

(a) a body having a first portion formed to fit a contour of said article of merchandise and a second portion formed to fit a carton in which said article is to be shipped;

(b) a magnetic element selected to provide a signal that is detectable by said electronic article surveillance system and incorporated into said body; and (c) means for limiting transmission of mechanical stress from said body to said magnetic element.

62. An integrated EAS marker and packing fixture according to claim 61, wherein said means for limiting transmission of mechanical stress comprises a lubricant coating on said magnetic element.

63. An integrated EAS marker and packing fixture according to claim 61, wherein said means for limiting transmission of mechanical stress comprises a cavity integrally formed in said body and shaped and sized to house said magnetic element therein so that said magnetic element is permitted to move within said cavity.

64. An article of merchandise to be protected from theft, the article comprising:

a member having a cavity formed integrally in said member, said cavity being defined by walls formed integrally in said member and by a first surface of a sealing member;

a magnetostrictive element housed in said cavity; and a biasing element applied on a second surface of said sealing member, said biasing element, when magnetically biased, for causing said magnetostrictive element to be mechanically resonant when exposed to an electromagnetic field generated at a selected frequency by an electronic article surveillance system, said cavity being shaped and sized to house said magnetostrictive element without constraining said mechanical resonance of said magnetostrictive element.

65. An article according to claim 64, wherein said biasing element comprises a layer of magnetic material formed on said second surface of said sealing member.

66. An article according to claim 64, wherein said member is a housing for defining a second cavity which encloses functional components of said article.

* * * * *

UNITED STATES PATENT AND TRADEMARK OFFICE

CERTIFICATE OF CORRECTION

PATENT NO. : 5,499,015

DATED : March 12, 1996

INVENTOR(S) : Stephen Winkler, et al.

It is certified that error appears in the above-identified patent and that said Letters Patent is hereby corrected as shown below:

Col. 10, line 5, after "claim" insert -- 1 --.

Col. 11, line 44, change "electrodeposition" to -- electro-deposition --.

Col. 14, line 36, change "With" to -- with --.

Signed and Sealed this

Twentieth Day of August, 1996

*Attest:*

*Attesting Officer*

BRUCE LEHMAN

*Commissioner of Patents and Trademarks*